US007452264B2

(12) United States Patent
Mavliev et al.

(10) Patent No.: US 7,452,264 B2
(45) Date of Patent: Nov. 18, 2008

(54) PAD CLEANING METHOD

(75) Inventors: Rashid A. Mavliev, Campbell, CA (US); Hung Chih Chen, Santa Clara, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 11/475,639

(22) Filed: Jun. 27, 2006

(65) Prior Publication Data

US 2007/0298692 A1 Dec. 27, 2007

(51) Int. Cl.
*B24B 53/00* (2006.01)

(52) U.S. Cl. ..... 451/56; 451/443; 451/72

(58) Field of Classification Search ..... 451/443, 451/444, 56, 73, 72
See application file for complete search history.

(56) References Cited

U.S. PATENT DOCUMENTS

| | | | | | |
|---|---|---|---|---|---|
| 4,450,652 | A | | 5/1984 | Walsh | |
| 4,471,579 | A | | 9/1984 | Bovensiepen | |
| 4,515,313 | A | | 5/1985 | Cavanaugh | |
| 5,308,438 | A | * | 5/1994 | Cote et al. | 216/86 |
| 5,584,146 | A | | 12/1996 | Shamouillan et al. | |
| 5,584,749 | A | * | 12/1996 | Mitsuhashi et al. | 451/285 |
| 5,643,050 | A | | 7/1997 | Chen | |
| 5,702,291 | A | * | 12/1997 | Isobe | 451/41 |
| 5,709,593 | A | | 1/1998 | Guthrie et al. | |
| 5,722,875 | A | | 3/1998 | Iwashita et al. | |
| 5,775,980 | A | | 7/1998 | Sasaki et al. | |
| 5,851,135 | A | | 12/1998 | Sandhu et al. | |
| 5,851,846 | A | | 12/1998 | Matsui et al. | |
| 5,916,010 | A | * | 6/1999 | Varian et al. | 451/38 |
| 5,957,750 | A | | 9/1999 | Brunelli | |
| 5,993,298 | A | * | 11/1999 | Duescher | 451/56 |
| 6,000,997 | A | | 12/1999 | Kao et al. | |
| 6,012,967 | A | | 1/2000 | Satake et al. | |
| 6,056,794 | A | | 5/2000 | Stoetzel et al. | |
| 6,077,151 | A | | 6/2000 | Black et al. | |
| 6,165,053 | A | | 12/2000 | Yokokawa et al. | |
| 6,217,422 | B1 | | 4/2001 | Franca et al. | |
| 6,280,299 | B1 | | 8/2001 | Kennedy et al. | |
| 6,319,098 | B1 | | 11/2001 | Osterheld et al. | |
| 6,358,124 | B1 | | 3/2002 | Koga et al. | |
| 6,582,487 | B2 | | 6/2003 | Larson et al. | |
| 6,612,422 | B2 | | 9/2003 | Roberts et al. | |
| 6,660,326 | B2 | | 12/2003 | Sano et al. | |
| 6,752,858 | B1 | | 6/2004 | Flynn et al. | |
| 6,878,629 | B1 | | 4/2005 | Li et al. | |
| 6,887,132 | B2 | * | 5/2005 | Kajiwara et al. | 451/41 |

(Continued)

OTHER PUBLICATIONS

Vortex Tubes, Oct. 6, 1998, 1998 EXAIR Corporation, pp. 1-3.

*Primary Examiner*—Robert Rose
(74) *Attorney, Agent, or Firm*—Patterson & Sheridan

(57) ABSTRACT

A method for cleaning a polishing pad is disclosed. In CMP and ECMP, a polishing pad must be conditioned to obtain good and predictable polishing results. During conditioning, debris is generated that must be removed to prevent processing defects. An effective method to clean a polishing pad is disclosed herein. In one embodiment, a washing fluid is directed at the pad to clean debris from the while a second fluid is utilized to remove the washing fluid. In another embodiment, the washing fluid is provided by a high pressure water jet while the second fluid is provided by an air knife.

9 Claims, 6 Drawing Sheets

U.S. PATENT DOCUMENTS

| | | | |
|---|---|---|---|
| 6,899,784 | B1 | 5/2005 | Li et al. |
| 6,910,951 | B2 | 6/2005 | Balyepalli et al. |
| 6,913,518 | B2 | 7/2005 | Chen |
| 6,918,821 | B2 | 7/2005 | Balyepalli et al. |
| 6,964,602 | B2 | 11/2005 | Chopra et al. |
| 2002/0026752 | A1 | 3/2002 | Culler et al. |
| 2002/0068516 | A1 | 6/2002 | Chen et al. |
| 2003/0024170 | A1 | 2/2003 | Larson et al. |
| 2003/0036273 | A1 | 2/2003 | Donoso |
| 2005/0126708 | A1 | 6/2005 | Chen et al. |
| 2005/0145507 | A1 | 7/2005 | Sun et al. |
| 2005/0186892 | A1 | 8/2005 | Chen et al. |
| 2006/0073768 | A1 | 4/2006 | Mavliev et al. |

* cited by examiner

PAD CLEANING METHOD

BACKGROUND OF THE INVENTION

1. Field of the Invention

Embodiments of the present invention relate to a method and apparatus for cleaning a pad used in chemical mechanical polishing (CMP) or electrochemical mechanical polishing (ECMP).

2. Description of the Related Art

ECMP is one method of planarizing a surface of a substrate. ECMP removes conductive materials from a substrate surface by electrochemical dissolution while polishing the substrate with a reduced mechanical abrasion compared to conventional CMP processes, which may require a high relative down force on a substrate to remove materials, such as metals and metal containing layers, from the substrate.

The polishing pad is one of the most critical parts for CMP or ECMP. The success or failure of the polishing process largely depends upon the pad. The pad has taken on a greater importance in recent years in ECMP wherein the pad provides two equally important functions, providing electrical contact to the substrate and providing surface abrasion. The pad to substrate contact area is what determines the pad performance in a polishing process, so it is critical to have a pad cleaning process that provides the best possible pad surface properties.

The surface of the pad is periodically conditioned to restore polishing performance. Conditioning is typically an abrasive process that may leave particles or other contaminants on the pad surface. To remove these contaminants, the pad is cleaned during and/or after conditioning.

One method for cleaning a pad includes rinsing the pad with a high pressure jet of liquid. Although high pressure rinsing may be suitable for cleaning conventional dielectric pads, the cleaning efficiency of a simple high pressure rinse is insufficient for ECMP processes due to the nature of the conductive pads utilized for ECMP processes. For example, debris located deep inside perforations in the conductive pad may be moved to the pad's surface during high pressure rinsing. Once at the pad's surface, the contaminants may stay on the surface or within scratches that are present on the surface of the pad.

There is a need in the art to provide an effective method and apparatus for cleaning polishing pads.

SUMMARY OF THE INVENTION

The present invention comprises a method for cleaning a polishing pad. In one embodiment, the method for cleaning a polishing pad comprises spraying the polishing pad with a washing fluid, and directing the washing fluid off of the pad. The washing fluid may be applied to the pad with a high pressure water jet (HPWJ). The washing fluid may be directed off of the polishing pad with a downstream director. The downstream director may be at least one of a fluid stream or spray, a vacuum, wiper or other object or device suitable for directing the washing fluid from the pad.

In another embodiment, the method for cleaning a polishing pad comprises directing polishing fluid off of the pad to create a fluid free zone, and spraying the fluid free zone of the polishing pad with a washing fluid. The washing fluid may be applied to the pad with a HPWJ. Fluids, such as polishing fluid, may be directed off of the polishing pad with an upstream director so that the washing fluid from the HPWJ is delivered directly to the pad without energy loss due to residual polishing fluid being disposed on the pad. The upstream director may be at least one of a gas stream or spray, a vacuum, wiper or other object or device suitable for directing the polishing fluid from the pad.

In another embodiment, the method for cleaning a polishing pad comprises rotating the polishing pad, spraying water from a HPWJ onto the polishing pad, and directing the water away from the polishing pad with air. The HPWJ and the air source may be positioned over the polishing pad using separate arms.

In yet another embodiment, an apparatus for cleaning a polishing pad is disclosed. The apparatus comprises a rotatable platen, a polishing pad disposed on the platen, an air jet mounted on a first delivery arm pivotable over said polishing pad, and an HPWJ mounted on a second delivery arm positioned over said polishing pad.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The present invention provides a method and apparatus for cleaning a polishing pad. While the invention will be described in the context of a conductive polishing pad, it should be understood that the method for cleaning a pad could be practiced on a dielectric polishing pad, and on a web polishing material, both conductive and dielectric. While the particular apparatus in which the present invention can be practiced is not limited, it is particularly beneficial to practice the invention in a REFLEXION LK ECMP™ system or MIRRA MESA® system sold by Applied Materials, Inc., Santa Clara, Calif. Additionally, apparatus described in U.S. patent application Ser. No. 10/941,060 filed Sep. 14, 2004, U.S. Pat. No. 5,738,574, and U.S. Pat. No. 6,244,935, which are hereby incorporated by reference in their entirety, can also be used to practice the invention.

Figure 1:
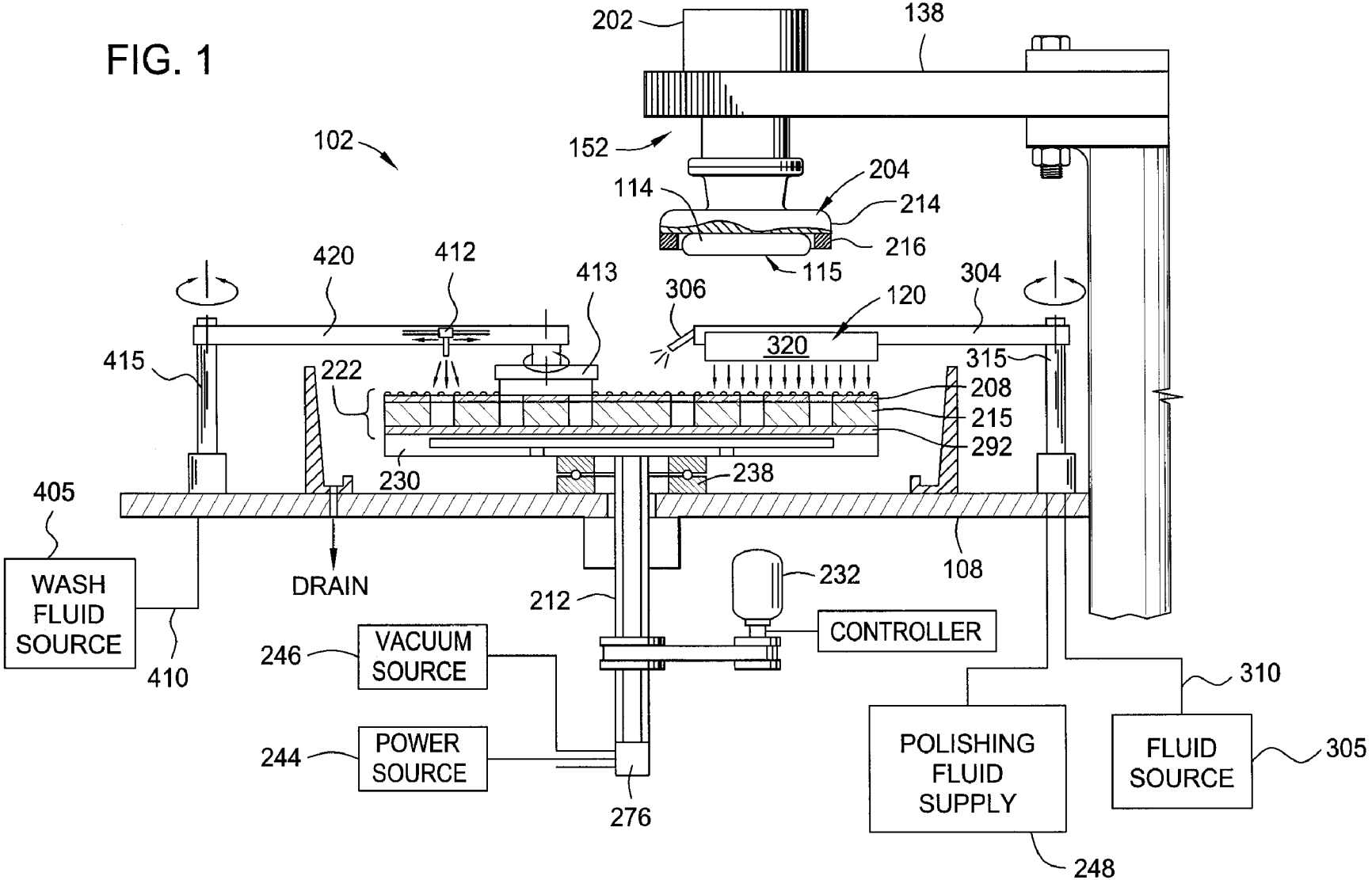
FIG. 1 is a side view of an ECMP station having one embodiment of the pad cleaning assembly of the invention.

FIG. 1 depicts a sectional view of an ECMP station 102 having a planarizing head assembly 152 positioned over a platen assembly 230. The planarizing head assembly 152 comprises a drive system 202 coupled to a carrier head 204 held by an arm 138. The drive system 202 provides at least rotational motion to the carrier head 204. The carrier head 204 additionally may be actuated toward the platen assembly 230 such that the substrate 114, retained in the carrier head 204, may be disposed against a contact surface of the ECMP station 102 during processing. The head assembly 152 may also oscillate during processing.

In one embodiment, the carrier head 204 may be a TITAN HEAD™ or TITAN PROFILER™ wafer carrier manufactured by Applied Materials, Inc. The carrier head 204 comprises a housing 214 and a retaining ring 216 that defines a center recess in which the substrate 114 is retained. The retaining ring 216 may circumscribe the substrate 114 disposed within the carrier head 204 to prevent the substrate 114 from slipping out from under the carrier head 204 during processing. The retaining ring 216 can be made of plastic materials such as PPS, PEEK, and the like, or conductive materials such as stainless steel, Cu, Au, Pd, and the like, or some combination thereof. It is further contemplated that a conductive retaining ring may be electrically biased to control the electric field during the ECMP process or an electrochemical plating process. It is also contemplated that other planarizing or carrier heads may be utilized.

The ECMP station 102 includes a platen assembly 230 that is rotationally disposed on a base 108. The platen assembly 230 is supported above the base 108 by a bearing 238 so that the platen assembly 230 may be rotated relative to the base 108. The platen assembly 230 is coupled to a motor 232 that provides the rotational motion to the platen assembly 230. The motor 232 is coupled to a controller that provides a signal for controlling for the rotational speed and direction of the platen assembly 230. The motor received its power from a power source 244, and a vacuum can be drawn from a vacuum source 246. The platen assembly 230 is fabricated from a rigid material, such as aluminum, rigid plastic, or other suitable material.

An area of the base 108 circumscribed by the bearing 238 is open and provides a conduit for the electrical, mechanical, pneumatic, control signals and connections communicating with the platen assembly 230. Conventional bearings, rotary unions and slip rings, collectively referred to as rotary coupler 276, are provided such that electrical, mechanical, fluid, pneumatic, control signals and connections may be coupled between the base 108 and the rotating platen assembly 230 through a hollow drive shaft 212.

A pad assembly 222 is disposed on an upper surface of the platen assembly 230. The pad assembly 222 may be held to the surface of the platen assembly 230 by magnetic attraction, static attraction, vacuum, adhesives, or the like. The pad assembly 222 depicted in FIG. 1 includes a contact layer 208 defining an upper surface of the pad assembly 222, a sub pad 215, and an electrode 292. The electrode 292 may be a single electrode, or may comprise multiple independently biasable electrode zones isolated from each other. Zoned electrodes are discussed in United States Patent Publication No. 2004/0082289, which is hereby incorporated by reference.

The upper surface of the contact layer 208 is adapted to contact a feature side 115 of the substrate 114 during processing. The contact layer 208 may be fabricated from polymeric materials compatible with the process chemistry. The polymeric materials may be dielectric or, alternatively, conductive. The contact layer 208 may be smooth or patterned to facilitate distribution of the polishing solution over the surface of the pad assembly 222. The pad assembly 222 may further include perforations 218 which expose the electrode 292 to process (e.g., polishing) fluids disposed on the upper surface of the contact layer 208 during processing.

The plurality of perforations 218 may be formed uniformly distributed pattern and has a percent open area of from about 10% to about 90% (i.e., the area of the perforations 218 open to the electrode as a percentage of the total surface area of the polishing layer). The location and open area percentage of the perforations 218 in the pad assembly 222 controls the quantity and distribution of polishing fluid contacting the electrode 292 and substrate 114 during processing, thereby controlling the rate of removal of material from the feature side 115 of the substrate 114 in a polishing operation, or the rate of deposition in a plating operation.

In another embodiment, the pad assembly 222 may include conductive contact elements adapted to extend above the contact layer 208. Examples of polishing pad assemblies having contact elements that may be utilized are described in United States Patent Publication No. 2002/0119286, United States Patent Publication No. 2004/0163946, and United States Patent Publication No. 2005/0000801, which are hereby incorporated by reference.

Polishing pad assemblies may be conditioned at three separate times. The first time that the polishing pad is conditioned is at break-in. Break-in is the procedure used to condition a new polishing pad before its first use. Polishing pads are broken-in to ensure uniform and predictable pad to pad processing results.

The second time that the polishing pad is conditioned is in-situ processing. In-situ conditioning occurs during processing of the substrate on the pad. In-situ maintains a substantially constant pad surface condition so that process variation is minimized between the beginning to end of a substrate polishing process.

The third time for polishing pad conditioning is ex-situ conditioning. Ex-situ conditioning occurs between polishing of substrates. Ex-situ conditioning may occur between each substrate processed, between batches of substrates, or on an as needed basis.

The method and apparatus for pad conditioning may be utilized with most conditioning processes. One conditioning process includes pressing a rotating disk against the pad assembly. The rotating disk is located at the end of an arm 420 that is supported on a support structure 415. The arm 420 is rotated to sweep the rotating disk 413 across the pad surface. One example of a pad conditioning process can be found in U.S. patent application Ser. No. 11/209,167, filed Aug. 22, 2005, which is hereby incorporated by reference in its entirety.

During polishing, a polishing fluid is provided from a polishing fluid supply 248 to the polishing pad assembly 222 through a polishing fluid delivery nozzle 306. The polishing fluid delivery nozzle 306 is located on a separate arm 304 from the arm 420 on which the conditioning pad assembly 413 is attached. The polishing fluid delivery nozzle 306 is positioned at the end of the arm 304. The arm 304 is coupled to a support structure 315 which allows the arm 304 to selectively position the delivery nozzle 306 over desired locations above the polishing pad assembly 222.

A washing fluid is provided to the polishing pad assembly 222 to remove debris that may collect on the surface of the polishing pad assembly 222 and within the perforations 218. The washing fluid is removed from the surface of the pad assembly by a downstream director 120 to prevent debris removed from the perforations from settling out of the washing fluid on the surface of the pad assembly and rotated into contact with the substrate 114 being polished on the polishing pad assembly 222. In one embodiment, the washing fluid is provided by a high pressure water jet (HPWJ). However it is to be understood that the washing fluid can be provided by other high pressure delivery devices and to the surface of polishing pad assembly 222.

In the embodiment depicted in FIG. 1, the downstream director 120 provides a second fluid to the polishing pad assembly 222 at an angle and velocity that moves the washing fluid out of an area of the polishing pad assembly 222 that will be swept under the substrate 114 during polishing. One suitable downstream director 120 is an air knife 320. While the second fluid is described as being provided from an air knife 320, it is to be understood that any fluid, gas or liquid that can be directed against the pad assembly to sweep the washing fluid wake and debris off of the polishing pad assembly 222 may be provided by other devices. Moreover, it is contemplate that the air knife 320 may be replaced by one or more fluid streams or sprays.

A washing fluid supply 405 provides the washing fluid that will be used to clean the polishing pad. The washing fluid is fed from the washing fluid supply 405 through a supply line 410 to one or more nozzles 412 that spray the washing fluid to the polishing pad 222. The nozzles 412 may be positioned on the same arm 420 as the conditioning pad assembly 413. In one embodiment, the washing fluid supply 405 is a HPWJ water supply, and the nozzle 412 is a HPWJ. In another embodiment, the washing fluid is water or deionized water. The nozzle 412 may be selectively positioned laterally along the arm 420.

Figure 3:
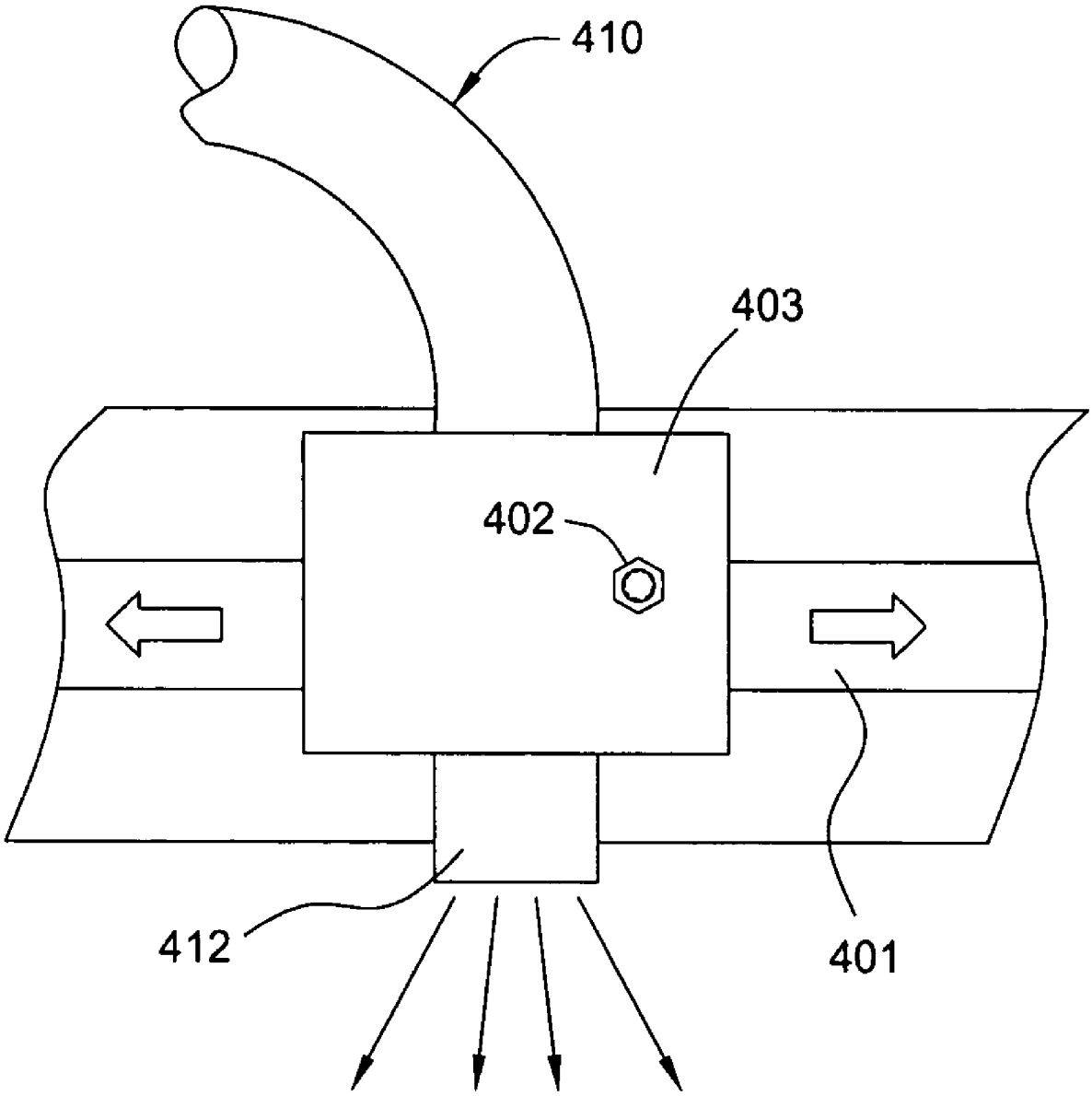
FIG. 3 is a partial side view of a high pressure water jet assembly of the invention.

FIG. 3 depicts a side view of the nozzle 412 mounted to the arm 420. The nozzle 412 is attached to a guide 403 that runs along a rail 401 mounted to the arm 420. The nozzle 412 may be dynamically positioned along the rail 401 using an actuator (not shown) or be locked in place using a clamp, detent or set screw 402.

To remove the washing fluid and any entrained debris prior to interfacing with the substrate, the downstream director 120, shown in this embodiment as an air knife 320, has a second nozzle that is provided to direct the second fluid against the pad assembly between the nozzle 412 and the carrier head 204 (as referenced by the pad rotation). The second fluid source is provided from a fluid source 305 and travels within the supply line 310 to the second nozzle, shown in FIG. 1 as an air knife 320. The air knife 320 provides the fluid to the polishing pad assembly 222 in a sheet that is oriented substantially radially across the pad. Thus, as the washing fluid disposed on the pad assembly rotates towards the carrier head 204, the sheet of second fluid creates a barrier that drives the washing fluid radially off the polishing pad assembly thereby substantially preventing the washing fluid from contacting the substrate. It is contemplated that the sheet may be alternatively formed by a plurality of nozzles. The air knife 320 may be coupled to the same arm 304 as the polishing fluid delivery nozzle 306.

In one embodiment, the second fluid is air. It is to be understood that the second fluid may be any gas or fluid that does not adversely effect processing of the substrate. The second fluid is delivered from the air knife 320 with sufficient force to remove the washing fluid. In one embodiment, the second fluid is delivered from an air knife to impinge the pad assembly over a linear span of at least 200 mm, and in another embodiment, at least 300 mm.

Figure 4A:
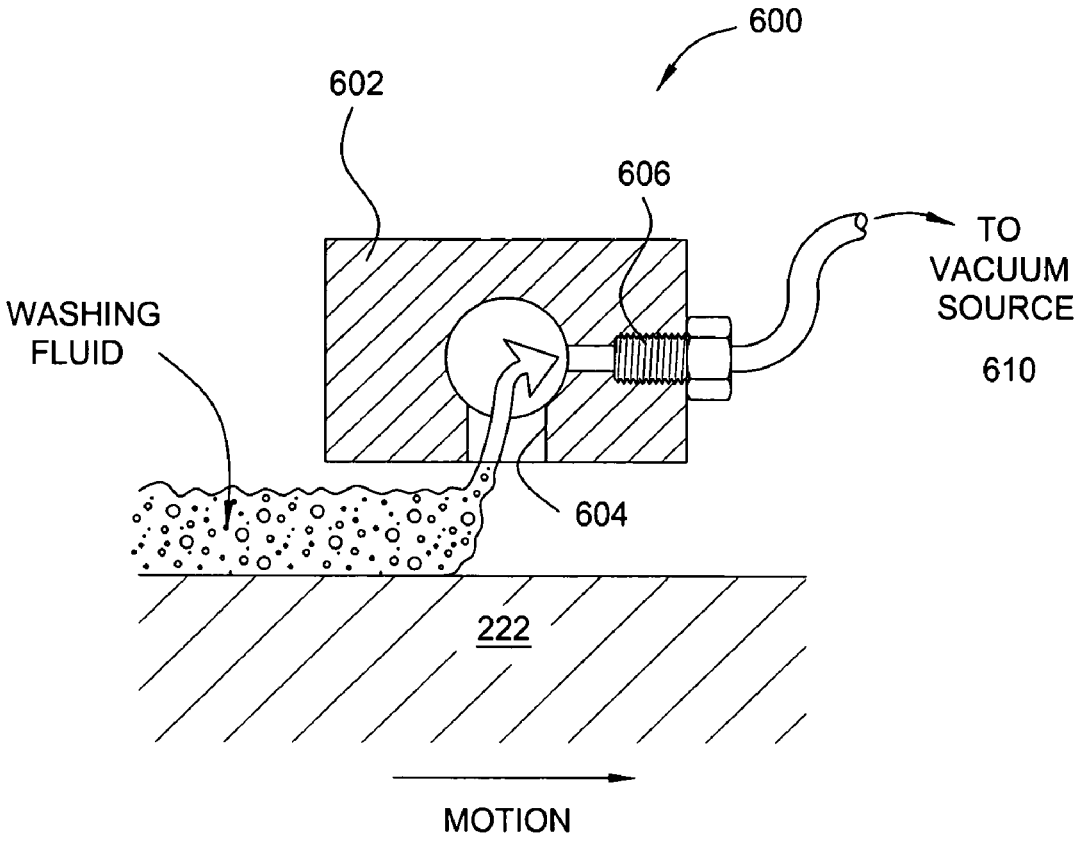
FIGS. 4A-B are partial side views of various embodiments of a downstream director of the invention.
Figure 4B:
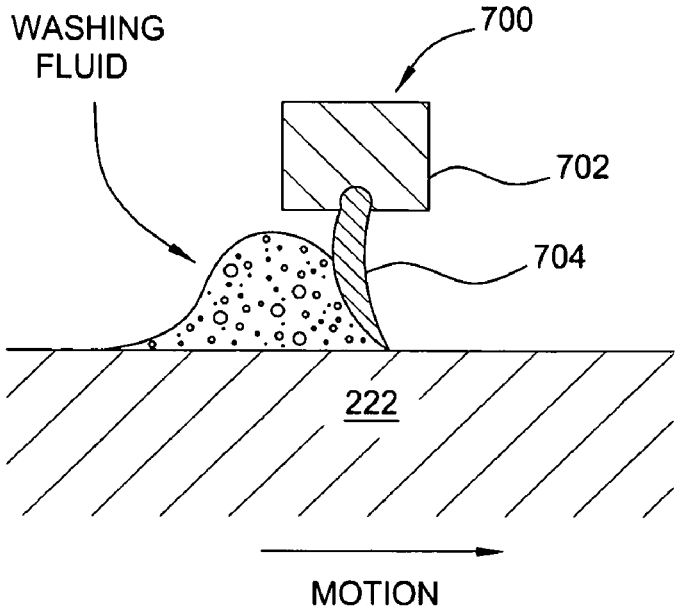

FIGS. 4A-B depict alternative embodiments of downstream directors that may be utilized in the ECMP stations described therein. In the embodiment depicted in FIG. 4A, a downstream director 600 includes a body 602 having one or more suction ports 604 one a side of the body 602 facing the polishing pad assembly 222. The suction port 604 is coupled to an exit port 606 formed in the body 602. The exit port 606 is coupled to a vacuum source 610. The vacuum source 610 pulls a vacuum though the suction port 604 that, when the body 602 is placed in close proximity to the polishing pad assembly 222, the washing fluid is removed from the surface of the pad assembly 222 through the director 600. The downstream director 600 may be coupled to the polishing fluid delivery arm 304 (not shown in FIG. 4B), or supported by another suitable member.

In the embodiment depicted in FIG. 4B, a downstream director 700 includes a body 702 having lip 704 extending from a side of the body 702 facing the polishing pad assembly 222. The lip 704 may be made from a material that does not damage the surface of the pad assembly 222 if placed in contact therewith. In one embodiment, the lip 704 is a polymer, such as an elastomer or plastic. The lip material is selected to be compatible with the fluids disposed on the pad assembly 222. When the body 702 is placed in close proximity to, or in contact with, the polishing pad assembly 222, the lip 704 of the director 700 wipes the washing fluid from the surface of the pad assembly 222. The downstream director 700 may be coupled to the polishing fluid delivery arm 304 (not shown in FIG. 4B), or supported by another suitable member.

Figure 2:
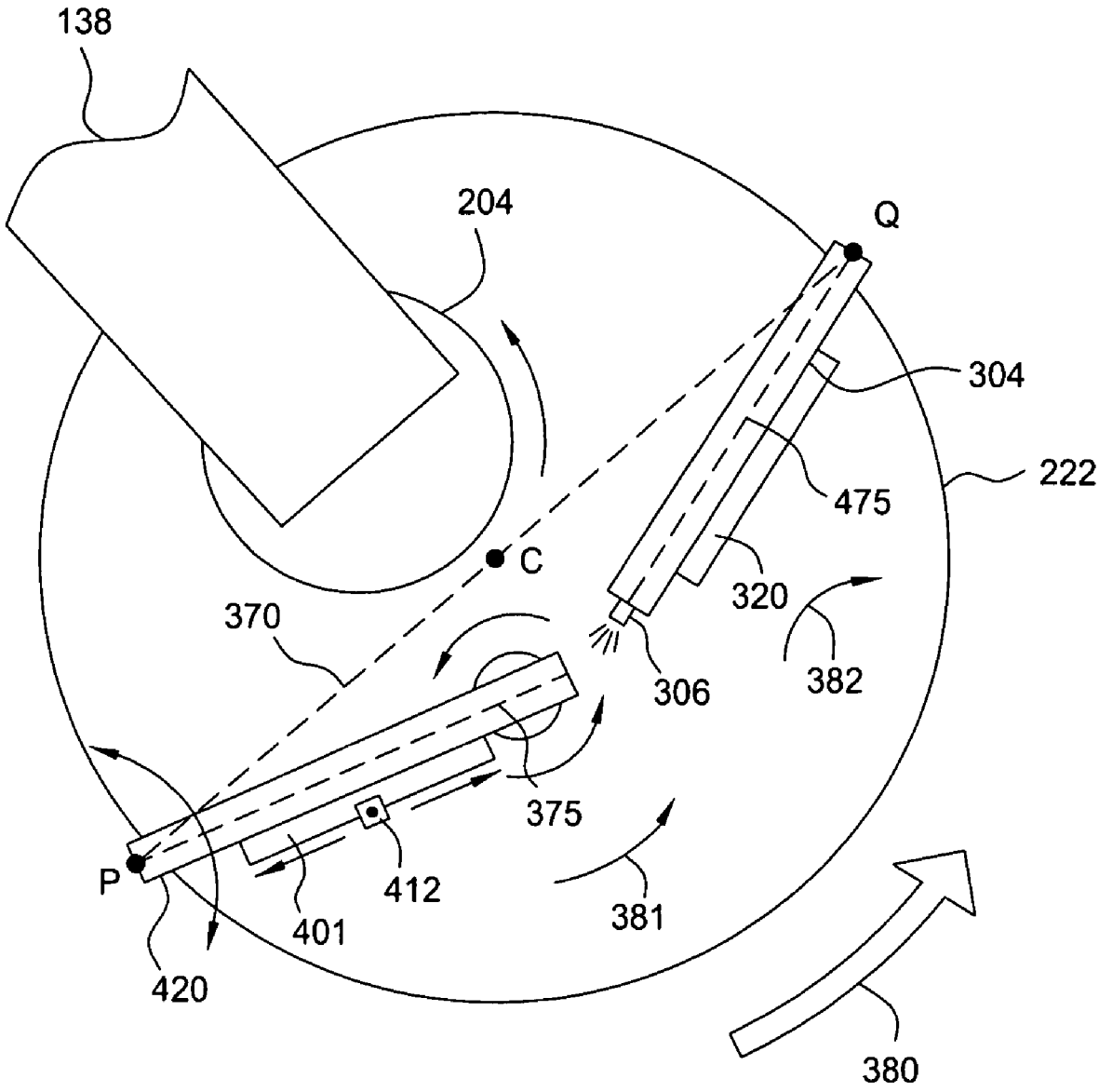
FIG. 2 is a top view of the ECMP pad station of FIG. 1.

FIG. 2 is a simplified top view of an ECMP station. The nozzle 412 is mounted on the arm 420 so that the nozzle 412 may be rotated relative to the pad 222. Further, the height of the nozzle 412 relative to the upper surface of the pad 222 may also be adjustable. The arm 420 is shown with its center line 375 at an angle relative to a radial centerline 370 of the pad 222 for convenience. It is to be understood that the arm 420 can pivot about its axis P so that the nozzle 412 can reach any point between the center C of the polishing pad 222 and the periphery. Arrow 380 denotes the direction of rotation of the pad 222.

The air knife 320 is mounted on the arm 304 so that the air knife 320 may be rotated relative to the pad 222. Further, the height of the air knife 320 relative to the upper surface of the pad 222 may also be adjustable. The arm 304 is shown with its center line 475 at an angle relative to a radial centerline 370 of the pad 222 for convenience. It is to be understood that the arm 304 can pivot about its axis Q so that the air knife 320 oriented across the polishing pad 222. Arrows 381 and 382 denote the path of the second fluid as it is directed off the polishing pad 222 by the air knife 320.

In operation, the washing fluid is sprayed onto the polishing pad at high pressure during and/or after conditioning. The washing fluid wake, along with any debris loosened from the polishing pad surface, is directed away from the polishing pad by the second fluid delivered to the pad surface by the air knife. In one embodiment, the washing fluid is directed to the polishing pad at about 1500 psi to about 2000 psi. In one embodiment, the washing fluid is directed to the polishing pad at about 1650 to about 1900 psi. In yet another embodiment, the washing fluid is directed to the polishing pad at about 1800 to about 1850 psi. During the cleaning, the washing fluid is swept across the surface of the polishing pad by pivoting the arm 420 about its axis P. Optionally, the nozzle 412 may be moved along the arm.

The polishing pad is rotated during the cleaning so that all areas of the polishing pad will be sprayed with the washing fluid. The polishing pad may be rotated at about 10 to about 100 rpm during the cleaning process. In another embodiment, the polishing pad to rotate at about 30 to about 60 RPM during the cleaning process. In another embodiment, the polishing pad rotated at about 40 to about 50 RPM during the cleaning process.

The washing fluid will clean debris from substantially all surfaces of the polishing pad, including the perforations. The spray of washing fluid may be directed towards the edge of the polishing pad so that any debris collected within the wake of the washing fluid will be swept away. The second fluid provided by the air knife will sweep away the washing fluid wake, as well as any debris collected by the washing fluid wake. The arm 304 may be pivoted about its axis if desired.

The second fluid and the washing fluid can be provided to the polishing pad simultaneously. It is also contemplated by the present invention for the second fluid to be provided before the washing fluid so that loose debris can be removed from the polishing pad surface. Additionally, it is contemplated that the washing fluid can be provided to the polishing pad before the second fluid.

Rotating the polishing pad during the cleaning is beneficial to the cleaning process. If the polishing pad is not rotated, then the washing fluid will be provided at a high pressure to only the area that the arm 420 holding the nozzles 412 can cover when rotated about its axis. The other areas of the polishing pad would only receive the washing fluid wake.

Figure 5:
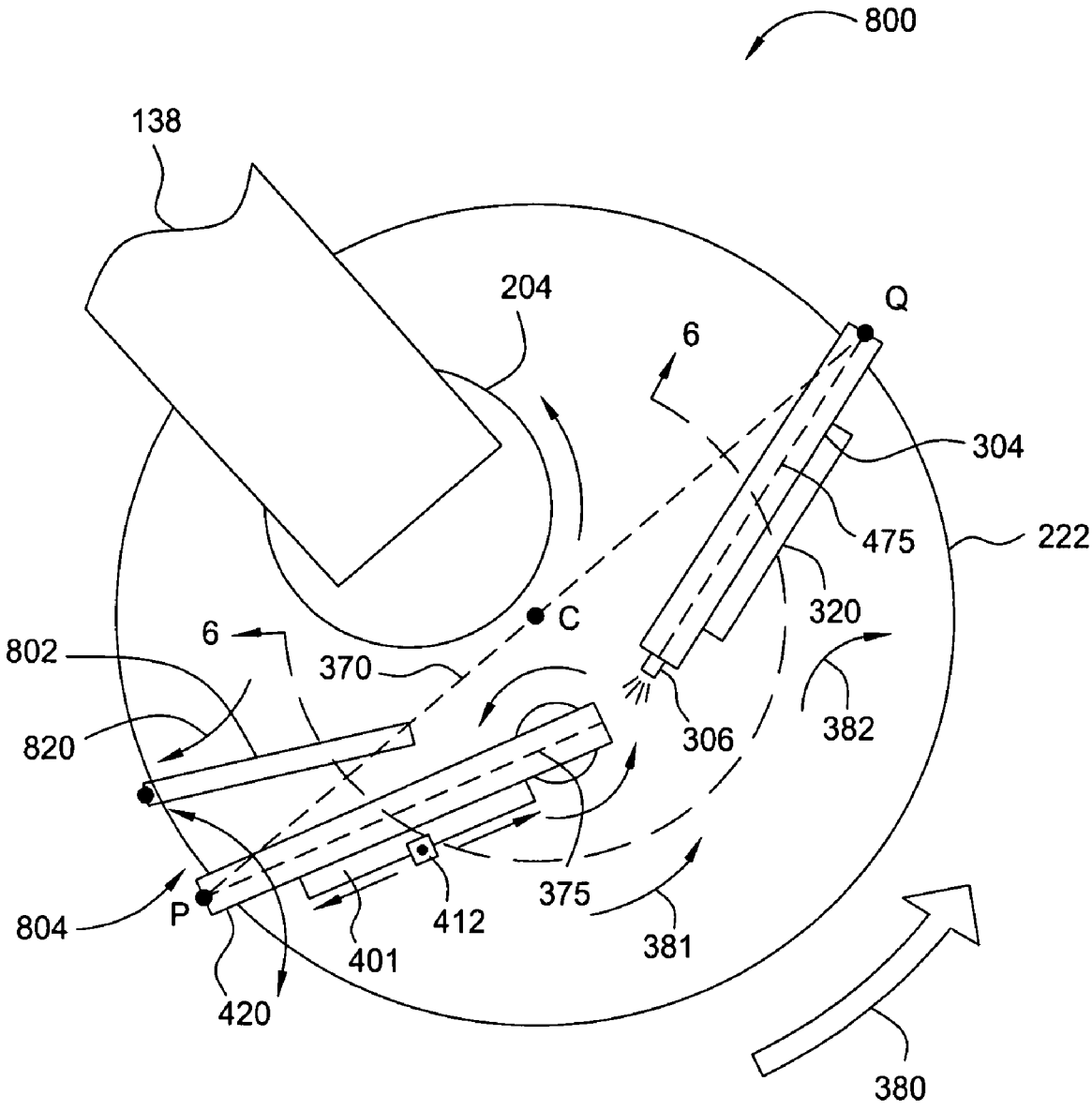
FIG. 5 is a plan view of another ECMP station having another embodiment of the pad cleaning assembly of the invention.
Figure 6:
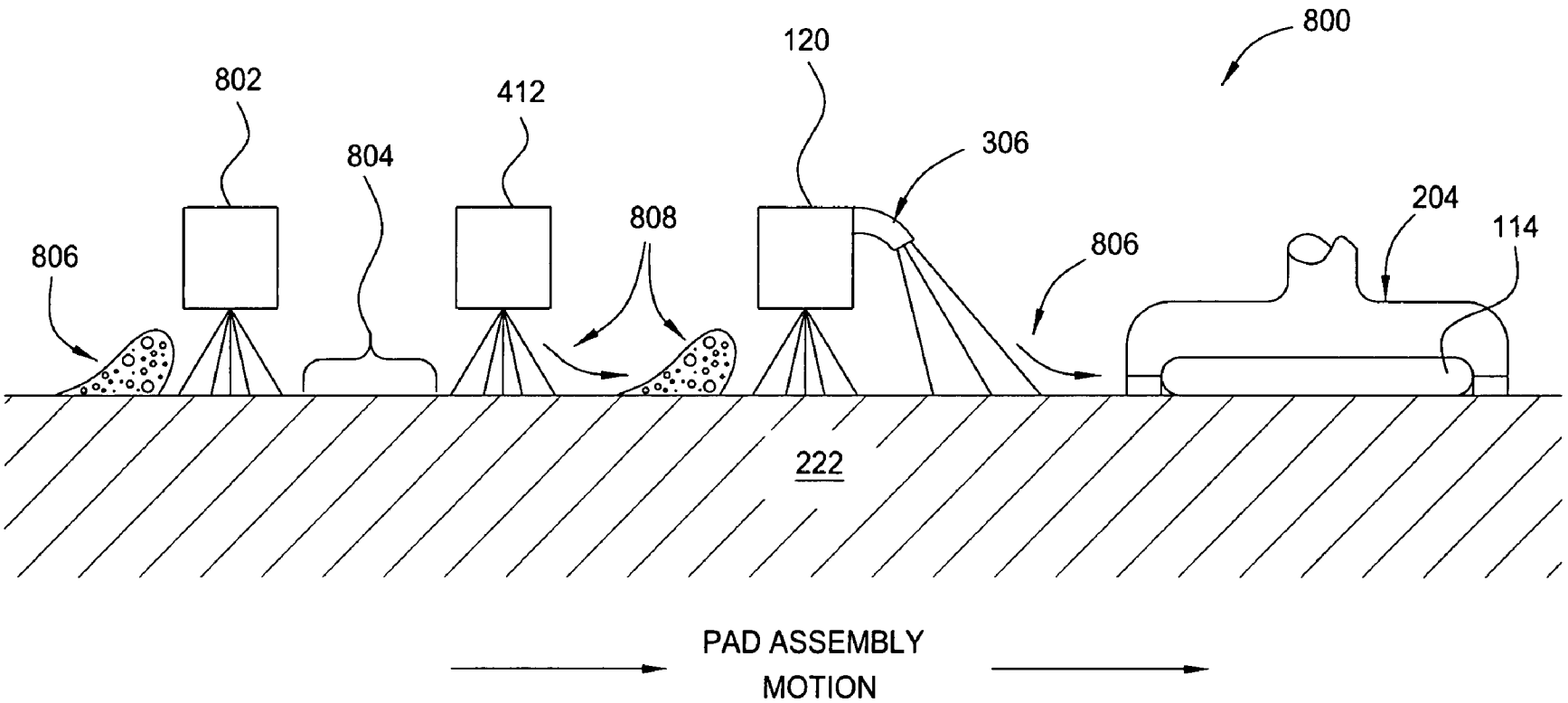
FIG. 6 is a partial side view of the ECMP station of FIG. 5 taken along section lines 6-6.

FIG. 5 is a plan view of another ECMP station 800 having another embodiment of the pad cleaning assembly of the invention. The ECMP station 800 generally includes a rotating disk 413 for conditioning a pad assembly 222, a polishing fluid delivery nozzle 306 and optionally, a downstream director 120. The ECMP station 800 also includes an upstream director 802 for directing polishing fluid 806 (after passing by or polishing the substrate 114) off of the pad assembly 222, as shown by arrows 820 to create a fluid free zone 804. The fluid free zone 804 is generally defined between the upstream director 802 and the HPWJ nozzle 412. The fluid free zone 804 has substantially no polishing fluid 806 disposed therein as compared to an area of the pad assembly 222 immediately upstream (via pad rotation) of the upstream director 802, as illustrated in the partial side view of the ECMP station 800 depicted in FIG. 6. Washing fluid 808 is sprayed the fluid free zone 804 of the polishing pad assembly 222. As substantially all of the polishing fluid has been removed from the surface of the pad assembly by the upstream director 802, the washing fluid may more energetically impinge upon the pad surface, thereby more effectively removing debris from the apertures of the pad assembly 222. The upstream director 802 may be at least one of a gas stream or spray, a vacuum, wiper or other object or device suitable for directing the polishing fluid from the pad, and may be constructed similar to as described with reference to the downstream director 120.

In embodiment wherein the downstream director 120 is present, the washing fluid 808 is moved off the pad assembly 222, as shown by arrows 381, 382, prior to dispensing the polishing fluid 806 on the pad assembly 222. Thus, the downstream director 120 substantially prevents intermixing of the washing and polishing fluids 806, 808 directly in front of the substrate 114.

While the foregoing is directed to embodiments of the present invention, other and further embodiments of the invention may be devised without departing from the basic scope thereof, and the scope thereof is determined by the claims that follow.

The invention claimed is:

1. An apparatus for cleaning a polishing pad comprising:

a rotatable platen;

a polishing pad disposed on the platen;

an upstream director for directing polishing fluid off of the polishing pad;

an air jet mounted on a first delivery arm pivotable over said polishing pad, the air jet separate from the upstream director;

a water jet mounted on a second delivery arm positioned over said polishing pad; and a rotatable conditioning disc for conditioning the polishing pad, the rotatable conditioning disc coupled with the second delivery arm.

2. The apparatus as claimed in claim 1, wherein said air jet comprises an air knife.

3. The apparatus as claimed in claim 1, wherein said polishing pad is a chemical mechanical polishing pad.

4. The apparatus as claimed in claim 1, wherein said polishing pad is an electrochemical mechanical polishing pad.

5. The apparatus of claim 1, wherein the upstream director is located upstream from the water jet.

6. The apparatus of claim 1, further comprising a fluid free zone defined between the director and the water jet.

7. The apparatus of claim 6, wherein the fluid free zone has substantially no polishing fluid disposed therein.

8. The apparatus of claim 1, wherein the upstream director comprises at least one of a gas stream, a spray, a vacuum, and a wiper.

9. The apparatus of claim 1, wherein a polishing fluid delivery nozzle is coupled with the first delivery arm.

* * * * *